US007468736B2

(12) United States Patent
Tsujino et al.

(10) Patent No.: US 7,468,736 B2
(45) Date of Patent: Dec. 23, 2008

(54) IMAGE FORMING APPARATUS

(75) Inventors: Kiyoshi Tsujino, Nagano (JP); Yujiro Nomura, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 159 days.

(21) Appl. No.: 11/249,747

(22) Filed: Oct. 12, 2005

(65) Prior Publication Data

US 2006/0092263 A1 May 4, 2006

(30) Foreign Application Priority Data

Oct. 12, 2004 (JP) ..... P2004-297240
Oct. 12, 2004 (JP) ..... P2004-297241
Oct. 12, 2004 (JP) ..... P2004-297242

(51) Int. Cl.
*G03G 15/01* (2006.01)
*B41J 2/45* (2006.01)

(52) U.S. Cl. ..... 347/244; 347/130; 347/238

(58) Field of Classification Search ..... 347/214, 347/244, 233, 130, 238
See application file for complete search history.

(56) References Cited

U.S. PATENT DOCUMENTS 3,641,564 A * 2/1972 Fassett et al. ..... 341/137
4,848,885 A * 7/1989 Clark ..... 359/216
5,341,165 A * 8/1994 Suzuki et al. ..... 347/132
6,479,942 B2 * 11/2002 Kimura ..... 315/169.3
6,583,805 B2 * 6/2003 Mashimo et al. ..... 347/241
6,731,322 B2 * 5/2004 Hori ..... 347/238
7,215,348 B2 * 5/2007 Nomura et al. ..... 347/132
2002/0018305 A1 * 2/2002 Kohno ..... 359/736
2002/0057329 A1 * 5/2002 Masuda ..... 347/241
2003/0020799 A1 * 1/2003 Koga et al. ..... 347/238
2004/0021762 A1 * 2/2004 Seki et al. ..... 347/136
2004/0075758 A1 * 4/2004 Nomura et al. ..... 348/242
2004/0089939 A1 * 5/2004 Ogihara et al. ..... 257/690
2004/0189556 A1 * 9/2004 Tsujino et al. ..... 345/82
2006/0050134 A1 * 3/2006 Kobayashi ..... 347/130

FOREIGN PATENT DOCUMENTS

JP 02-273258 11/1990
JP 11-198433 7/1999
JP 2000-103114 4/2000
JP 2003-019826 1/2003
JP 2004-050816 2/2004

* cited by examiner

*Primary Examiner*—Huan H Tran
(74) *Attorney, Agent, or Firm*—Hogan & Hartson LLP

(57) ABSTRACT

A photosensitive member is movable in a first direction. A line head is provided with a plurality of organic-EL photo emitters, arrayed in a second direction perpendicular to the first direction to form a plurality of photo emitter arrays arranged in the first direction. A plurality of imaging lenses are arrayed in the second direction to form at least one lens array, so that an array of pixels defined on the photosensitive member are subjected to multiple exposure to light emitted from the photo emitter arrays in accordance with the movement of the photosensitive member, thereby forming an electrostatic latent image on the photosensitive member. At least one chromatic-aberration correcting lens is adapted to correct chromatic aberration of the imaging lenses relative to the first direction, and disposed between the photo emitter arrays and the lens array.

8 Claims, 13 Drawing Sheets

IMAGE FORMING APPARATUS

BACKGROUND OF THE INVENTION

The present invention relates to an image forming apparatus for exposing light emitted from an organic-EL (electro luminescence) photo emitter array onto a photosensitive member by an image forming optical system.

In an image forming apparatus such as a copying machine, a printer or a facsimile using an electrophotographic technique, conventionally, there have been known an image forming apparatus for scanning a laser beam irradiated from a laser beam source by using a rotary polygon mirror to form an electrostatic latent image on a photosensitive member and an image forming apparatus for forming an electrostatic latent image on a photosensitive member by using an LED (light emitting diode) array having a plurality of LEDs arranged linearly. Moreover, there has also been known an image forming apparatus having an organic-EL photo emitter arranged linearly. Exemplified configurations are disclosed in Japanese Patent Publication Nos. 2-273258A, 11-198433A, 2000-103114A and 2004-50816A.

In case of an exposing method using a laser beam, however, there is a problem in that an optical component such as a polygon mirror or a lens is required, it is hard to reduce the size of an apparatus and it is also hard to increase an operation speed largely. In a color image forming apparatus having a tandem arrangement, furthermore, it is hard to enhance precision in the scanning positions of four scanning beams. For this reason, there is a problem in that a color deviation is generated, resulting in a deterioration in image quality.

In case of an exposing method using an LED array in which a large number of minute LEDs are arranged linearly, the LED can generally obtain a high luminance. However, the LED is basically manufactured by using a semiconductor process. For this reason, a substrate is expensive and a substrate length cannot be increased in respect of a manufacturing yield. Therefore, it is necessary to arrange a large number of chips in a line to form the LED array. In that case, there is a problem in that a step between the chips and the error of a space cause a variation in the luminance and a density unevenness remarkably appears on an image.

An organic-EL photo emitter using an organic polymer substance for a light emitting layer is easier to manufacture and has a smaller amount of heat generation as compared with other photo emitters. Therefore, a radiation fin for cooling can be omitted and the thickness and weight of an exposer can be reduced. However, the light emitting wavelength of the organic-EL photo emitter has a large half-value width of approximately 100 nm. Therefore, an effective wavelength distribution (a light emitting wavelength distribution seen from a photosensitive member) also has a great half-value width of approximately 100 nm.

FIG. 13 shows the state that an image formation is performed on a photosensitive member 2 by irradiating light emitted from a light emitting section 8 of the organic-EL photo emitter 6 through a rod lens 3. The organic-EL photo emitter has a great light emitting wavelength distribution. For this reason, a beam having a long wavelength shown in a dashed line forms an image in a great spot diameter on the photosensitive member 2 by the chromatic aberration of the rod lens 3.

FIG. 14 is a chart showing the comparison of a light emitting intensity and a spot diameter between light having a single wavelength and light having a large wavelength distribution as in the organic-EL photo emitter 6. The spot diameter (a dashed line) of the organic-EL photo emitter 6 having a large wavelength distribution is greater than the spot diameter (a solid line) of the light having a single wavelength. As a result, there is a problem in that a clear image is formed with difficulty. When the spot diameter is increased, the contour of an image is not clear so that image quality is influenced.

Japanese Patent Publication Nos. 2000-103114A and 2004-50816A disclose a line head having a plurality of organic-EL photo emitters arrayed in the primary scanning direction of a photosensitive member (note: this term is defined when a scanning optics is used to irradiate the photosensitive member), and a plurality of arrays are arranged in the secondary scanning direction of the photosensitive member (note: also defined as a moving direction of the photosensitive member) for carrying out a multiple exposure over the same pixel on the photosensitive member.

In a case where the organic-EL photo emitters in each of the arrays are controlled with the PWM (pulse width modulation) technique to perform a gradation reproduction, the spots of the organic-EL photo emitters in the arrays are superposed on the same pixel on the photosensitive member and are thus exposed to light. Therefore, precision in the shape of the spot of the photosensitive member greatly influences image quality. In a case where a pitch between pixel lines in the secondary scanning direction is small, particularly, a blank portion between the adjacent lines is lost so that the quality of an image is deteriorated when the spot diameter in the secondary scanning direction is increased.

SUMMARY OF THE INVENTION

It is an object of the invention to provide an image forming apparatus using a line head of an organic-EL photo emitter which has a simple structure and can prevent an increase in a spot diameter from being caused by a wavelength distribution, and can carry out a high-quality gradation reproduction with the PWM control.

In order to achieve the above object, according to the invention, there is provided an image forming apparatus, comprising:

- a photosensitive member, being movable in a first direction; and
- a line head, comprising:
  - a plurality of organic-EL photo emitters, arrayed in a second direction perpendicular to the first direction to form a plurality of photo emitter arrays arranged in the first direction;
  - a plurality of imaging lenses, arrayed in the second direction to form at least one lens array, so that an array of pixels defined on the photosensitive member are subjected to multiple exposure to light emitted from the photo emitter arrays in accordance with the movement of the photosensitive member, thereby forming an electrostatic latent image on the photosensitive member; and
  - at least one chromatic-aberration correcting lens, adapted to correct chromatic aberration of the imaging lenses relative to the first direction, and disposed between the photo emitter arrays and the lens array.

With this configuration, the spot diameter in the first direction which is important in the gradation reproduction through the multiple exposure of the organic-EL photo emitters arranged in the first direction can be prevented from being increased by the chromatic aberration of the imaging lenses so that an image having high quality can be obtained. In a case where a pitch in the first direction of pixel arrays is small, particularly, a blank portion between the adjacent pixel arrays can be held and a contour portion can be made clear so that the image quality can be enhanced.

The chromatic-aberration correcting lens may have a single body elongated in the second direction. In this case, fabrication and positioning of the chromatic-aberration correcting lens can be facilitated.

Alternatively, a plurality of chromatic-aberration lenses may be provided and arranged such that one of the chromatic-aberration lenses and one of the imaging lenses are opposed to each other. In this case, the aberration correcting effect can be enhanced.

The chromatic-aberration correcting lens may be separately provided from a substrate on which the photo emitter arrays are provided. In this case, the fabrication of the chromatic-aberration correcting lens can be facilitated.

Alternatively, the chromatic-aberration correcting lens may be integrally formed with a substrate on which the photo emitter arrays are provided. In this case, it is possible to reduce the size of the apparatus, and furthermore, to cause the central position of the light emitting section of the photo emitter to be coincident with the central position of the chromatic-aberration correcting lens during a manufacturing process.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
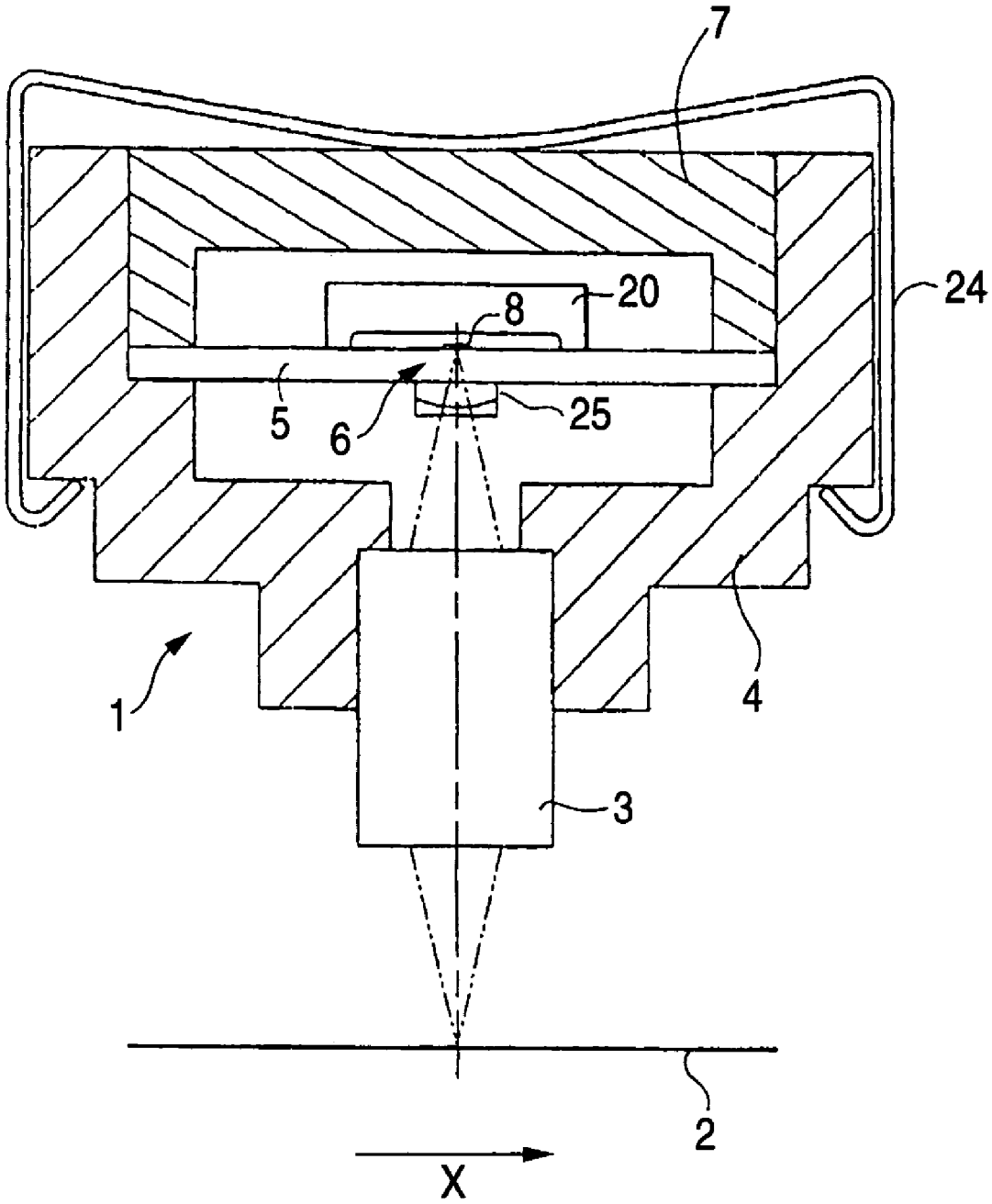
FIG. 1 is a section view of a line head in an image forming apparatus according to a first embodiment of the invention.

As shown in FIG. 1, an image forming apparatus according to a first embodiment comprises an exposer (line head) 1 using organic-EL photo emitters 6 and a photosensitive member 2. The organic-EL photo emitters 6 are made of organic polymer substance such as PPV, PEDT, and polydialkylfluorene. The exposer 1 comprises an opaque housing 4 provided with gradient index type rod lenses 3 being opposed to the photosensitive member 2. The rod lenses 3 are arrayed in a direction Y (see FIG. 11; so-called primary scanning direction) to form a rod lens array 3' and a plurality of rod lens arrays 3' are arranged in a direction X that the photosensitive member 2 moves (so-called secondary scanning direction). The number of the rod lens array 3' may be at least one.

The organic-EL photo emitters 6 are formed on a glass substrate 5 attached to the opaque housing 4 so as to face the back side of the rod lenses 3. The organic-EL photo emitters 6 are arrayed in the direction Y, thereby constituting a photo emitter array 6', and a plurality of photo emitter arrays 6' are arranged in the direction X. The rod lens array 3' and the photo emitter array 6' are positioned to oppose to each other.

A chromatic-aberration correcting lens 25 for correcting a chromatic aberration relative to the direction X is provided between the photo emitter array 6' and the rod lens array 3'. The chromatic-aberration correcting lens 25 is formed separately so as to have a body elongated in a direction parallel to the photo emitter array 6'. There is provided an opaque cover 7 for shielding the photo emitter array 6' on an inside from the back face of the opaque housing 4, and the opaque cover 7 is pressed against the back face of the housing 4 by a leaf spring 24, thereby closing the housing 4 to be lightproof.

Figure 2:
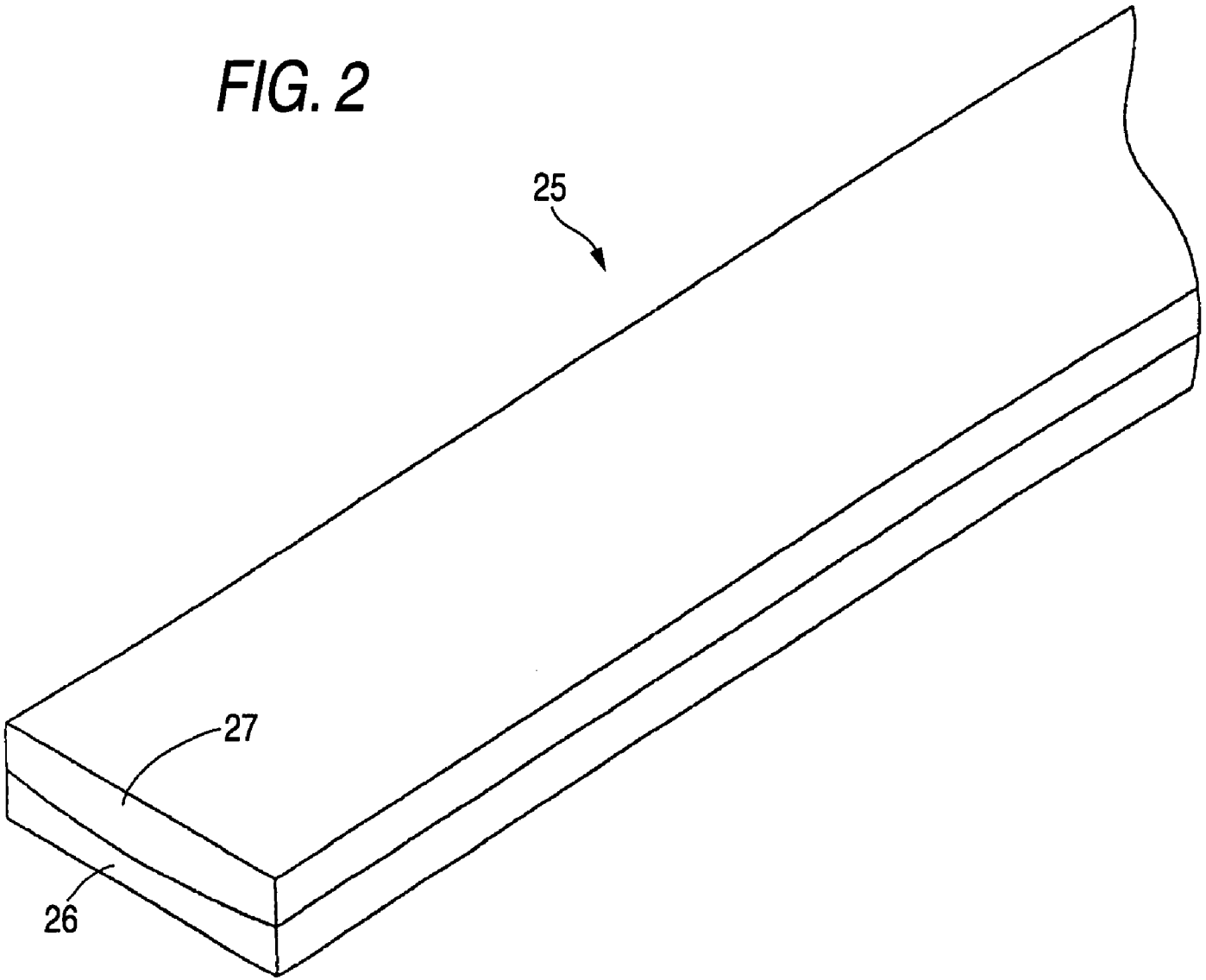
FIG. 2 is a partial perspective view of a chromatic-aberration correcting lens in the line head of FIG. 1.

As shown in FIG. 2, the chromatic-aberration correcting lens 25 is formed by bonding and integrating a first lens 26 having a concave portion elongated in the direction Y (i.e., parallel to the rod lens array 3' and the photo emitter array 6') and a second lens 27 having a convex portion elongated in the same direction. The chromatic-aberration correcting lens 25 thus formed corrects a chromatic aberration of light emitted from the photo emitter array 6' relative to the direction X and forms the image of a spot having a corrected chromatic aberration on the photosensitive member 2 through the rod lens array 3'. The chromatic-aberration correcting lens 25 is fixed and arranged onto the glass substrate 5.

Figure 3:
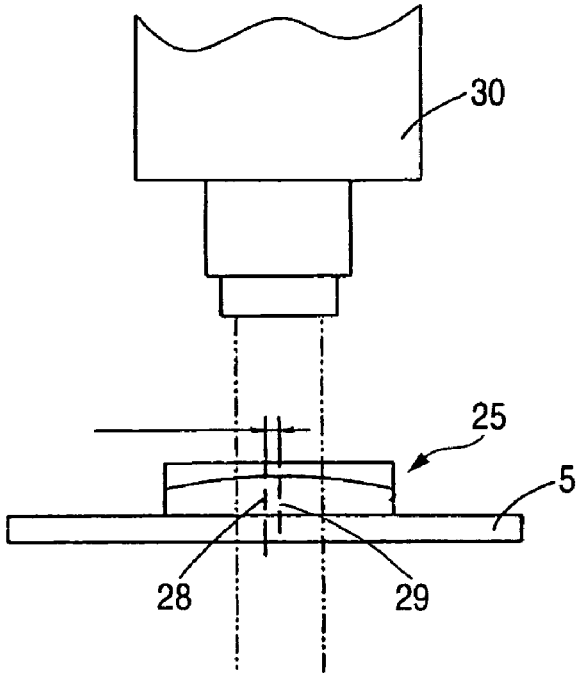
FIG. 3 is a diagram for explaining how to determine the position of the chromatic-aberration correcting lens.

FIG. 3 shows a structure for positioning and arranging the chromatic-aberration correcting lens 25 with respect to the glass substrate 5 provided with a light emitting section 8 of each organic-EL photo emitter 6. The amount of a shift between a central position 28 of the light emitting section 8 of the organic-EL photo emitter 6 and a central position 29 of the chromatic-aberration correcting lens 25 is detected by an optical device 30 such as a camera so that the chromatic-aberration correcting lens 25 is provided in an accurate position.

Figure 4:
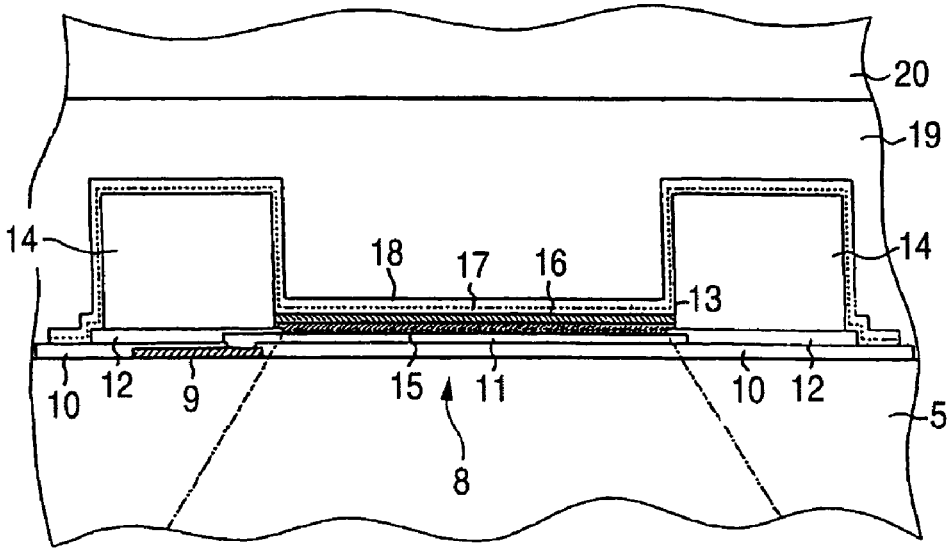
FIG. 4 is a section view of a photo emitter in the line head of FIG. 1.

As shown in FIG. 4, in each of the organic-EL photo emitters 6, a TFT (thin film transistor) 9 having a thickness of 50 nm and formed of polysilicon which serves to control the light emission of the light emitting section 8 is provided on the glass substrate 5 having a thickness of 0.5 mm corresponding to the light emitting section 8, for example.

An insulating film 10 having a thickness of approximately 100 nm and formed of $SiO_2$ is provided on the glass substrate 5 excluding a contact hole formed on the TFT 9. An anode 11 having a thickness of 150 nm and formed of ITO is provided in the position of the light emitting section 8 so as to be connected to the TFT 9 through the contact hole. Another insulating film 12 having a thickness of approximately 120 nm and formed of $SiO_2$ is provided in a corresponding portion to a position other than the light emitting section 8. A bank 14 forming a hole 13 corresponding to the light emitting section 8 and made of polyimide having a thickness of 2 μm is provided on the insulating film 12. A hole-injected layer 15 having a thickness of 50 nm and a light emitting layer 16 having a thickness of 50 nm are formed in order from the anode 11 in the hole 13 of the bank 14. A first cathode layer 17 having a thickness of 100 nm and formed of Ca and a second cathode layer 18 having a thickness of 200 nm and formed of Al are sequentially formed to cover the upper surface of the light emitting layer 16, the internal surface of the hole 13 and the external surface of the bank 14, and they are covered with a cover glass 20 having a thickness of approximately 1 mm through an inert gas 19 such as a nitrogen gas so that the light emitting section 8 of the organic-EL photo emitter 6 is constituted. Light is emitted from the light emitting section 8 toward the glass substrate 5 side.

Figure 5:
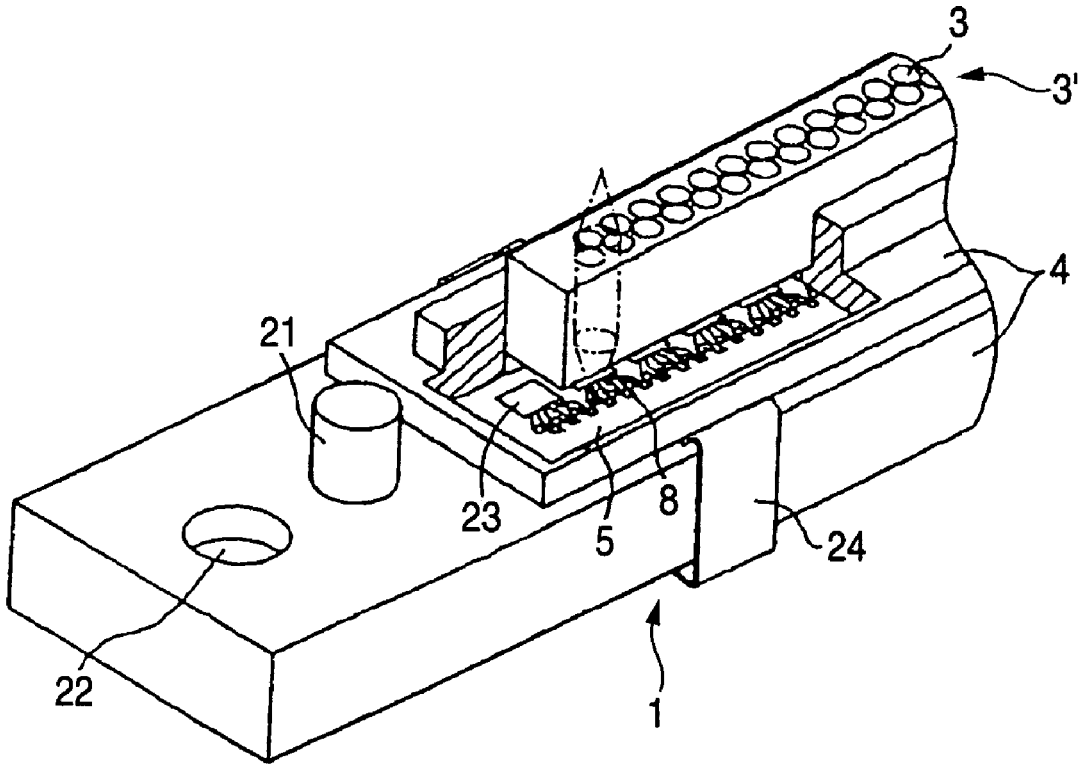
FIG. 5 is a perspective view of the line head of FIG. 1.

As shown in FIG. 5, a plurality of light emitting sections 8 are arrayed to form a photo emitter array 6', and a plurality of photo emitter arrays 6' are arranged in the moving direction of the photosensitive member 2 (so-called secondary scanning direction). In addition, a plurality of rod lens arrays 3' are arranged so as to correspond to the photo emitter arrays 6'. However, one of the rod lens array 3' may be corresponded to a plurality of the photo emitter arrays 6'. With respect to one array of pixels defined on the photosensitive member 2, one of the photo emitter arrays 6' first performs exposure. Then, the photosensitive member 2 is moved so that the one array of pixels are subjected to the exposure performed by another one of the photo emitter arrays 6'. Accordingly, each array of pixels can be subjected to the multiple exposure.

The chromatic-aberration correcting lens 25 formed separately is provided between the light emitting sections 8 of the photo emitter array 6' and the rod lens array 3'. Positioning pins 21 provided on both longitudinal ends of the housing 4 are fitted in the opposed positioning holes of the case of the photosensitive member unit, and furthermore, screws are inserted and fixed into the screw holes of the case through fixed screw holes 22 provided on the both longitudinal ends of the housing 4, thereby fixing the exposer 1 into a predetermined position. In FIG. 5, numeral 23 denotes a driving circuit.

When a multiple exposure is to be carried out over the same array of pixels on the photosensitive member 2 by the photo emitter arrays 6' through the rod lens array 3', the chromatic-aberration correcting lens 25 formed separately corrects a chromatic aberration in the direction that the photosensitive member 2 moves (the direction X). Therefore, it is possible to prevent an increase in the direction X of a spot, thereby enhancing the obtained image quality.

Figure 6:
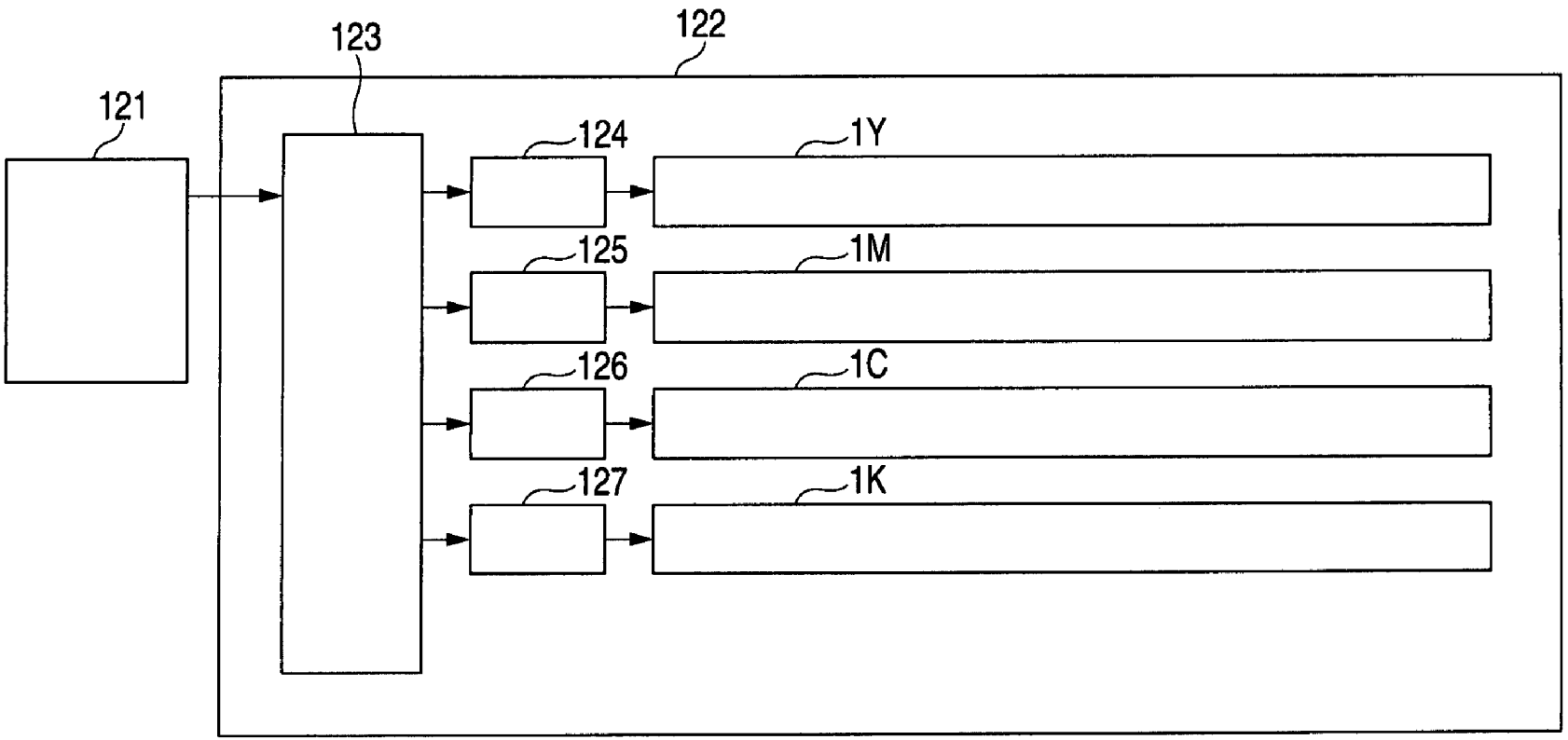
FIG. 6 is a block diagram of a printer controller in the image forming apparatus.

As shown in FIG. 6, a host computer 121 generates print data and transmits the print data to a printer controller 122 of the image forming apparatus. The printer controller 122 comprises a data processor 123, storages 124 to 127, and the above-described line heads 1 (Y, M, C, K) arranged corresponding to the storages 124 to 127.

The line heads 1 (Y, M, C, K) correspond to colors of yellow, magenta, cyan and black respectively and serve to form color images on the photosensitive member 2. The storages 124 to 127 store image data corresponding to the line heads 1 (Y, M, C, K) for the respective colors.

The data processor 123 executes processings such as a color separation, a gradation processing, the conversion of image data into bit map data and the regulation of a color deviation based on the print data transmitted from the host computer 121. The data processor 123 outputs image data for each array of pixels to the storages 124 to 127.

Since a plurality of photo emitter arrays 6' are provided in each of the line heads 1 (Y, M, C, K) to execute the multiple-exposure with respect to the same array of pixels on the photosensitive member 2, the storages 124 to 127 are so configured as to output image data for the plural photo emitter arrays 6'.

Figure 7:
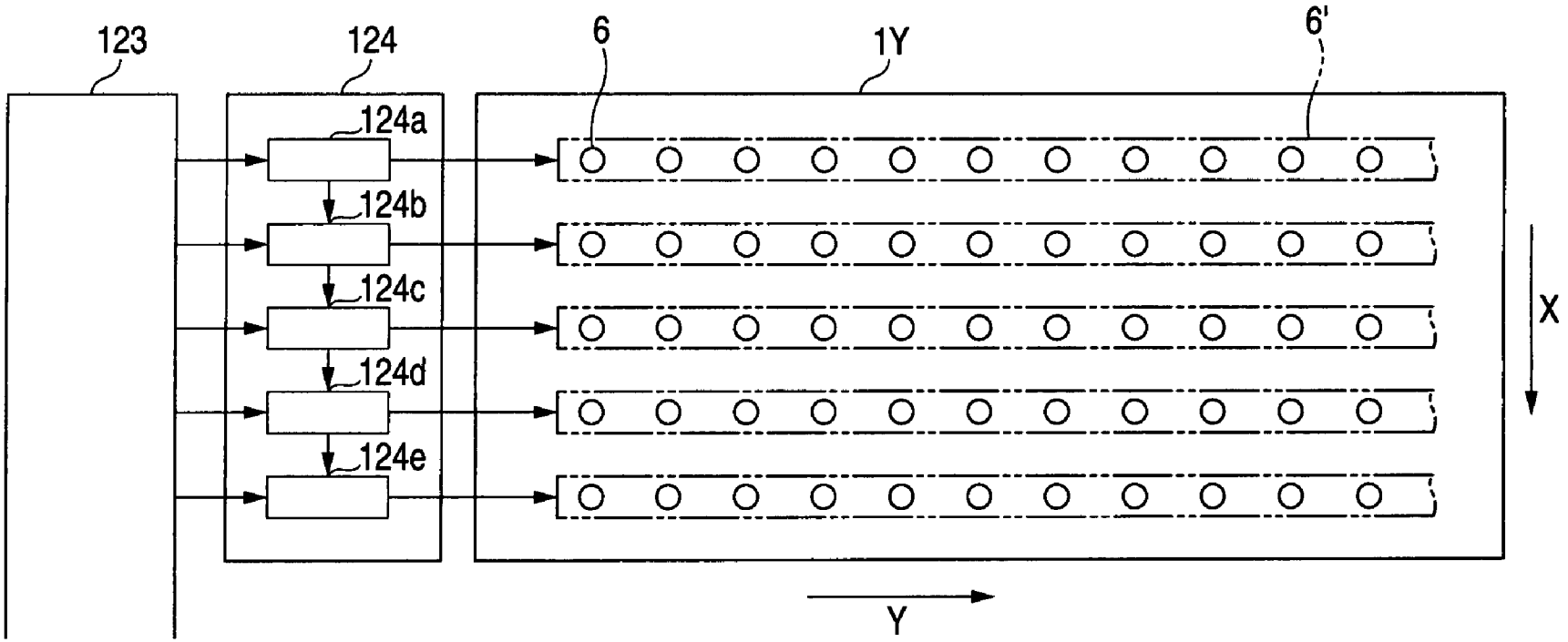
FIG. 7 is a block diagram of details for one of storages and one of line heads shown in FIG. 6.

Specifically, as shown in FIG. 7, a plurality of organic-EL photo emitters 6 are arrayed in the direction Y (so-called primary scanning direction) to form a photo emitter array 6', and five photo emitter arrays 6' are arranged in the direction X (so-called secondary scanning direction). The storages 124 has shift registers 124*a* to 124*e* provided corresponding to the respective photo emitter arrays 6'.

When image data are input from the data processor 123 to the storage 124, they are output from the shift register 124*a* to the first photo emitter array 6' and an array of pixels on the photosensitive member 2 is exposed in a predetermined amount of light by the respective photo emitters 6 in the first photo emitter array 6'.

The photosensitive member 2 is moved in the direction X, and the pixel exposed by the first photo emitter array 6 is caused to reach the position of the organic-EL photo emitters 6 arranged in the second photo emitter array 6'. In this timing, the image data input to the shift register 124*a* are transferred to the shift register 124*b*.

The shift register 124*b* outputs image data to the second photo emitter array 6', thereby operating the organic-EL photo emitters 6 provided therein. For this reason, the pixels exposed by the first photo emitter array 6' is exposed by the second photo emitter array 6' again in an amount of light having the same intensity.

Thus, the photosensitive member 2 is moved in the direction X, and at the same time, the image data are sequentially transferred to the shift registers in subsequent stages to sequentially expose the same array of pixels with different photo emitter arrays 6'.

In the example of FIG. 7, therefore, each pixel is exposed in an amount of light which is five times as large as the amount of light in a case where it is exposed by a single organic-EL photo emitter. Consequently, it is possible to quickly acquire an amount of light which is necessary for the exposure of each pixel. The number of photo emitter arrays 6' in the direction X secondary, that is, the multiple of the amount of light obtained in a case where one array of pixels are exposed by the single photo emitter array 6' can be selected properly if necessary.

In a case where a gradation control for a halftone density is to be carried out with the structure shown in FIG. 7, image data having a luminance of 0.1 are input from the data processor 123 to the shift register 124*a* when a predetermined luminance is set to be 1, for example. By a processing of sequentially transferring the image data to the shift registers 124*a* to 124*e* while moving the photosensitive member 2 and outputting the same image data to the photo emitter arrays 6' as described above, a luminance of one pixel is set to be 0.5 so that the halftone density can be obtained. The luminescence (amount of emitted light) is controlled by the PWM technique.

Each of the storages 125, 126 and 127 respectively corresponding to the line heads 1M, 1C and 1K has the same configuration.

Figure 8:
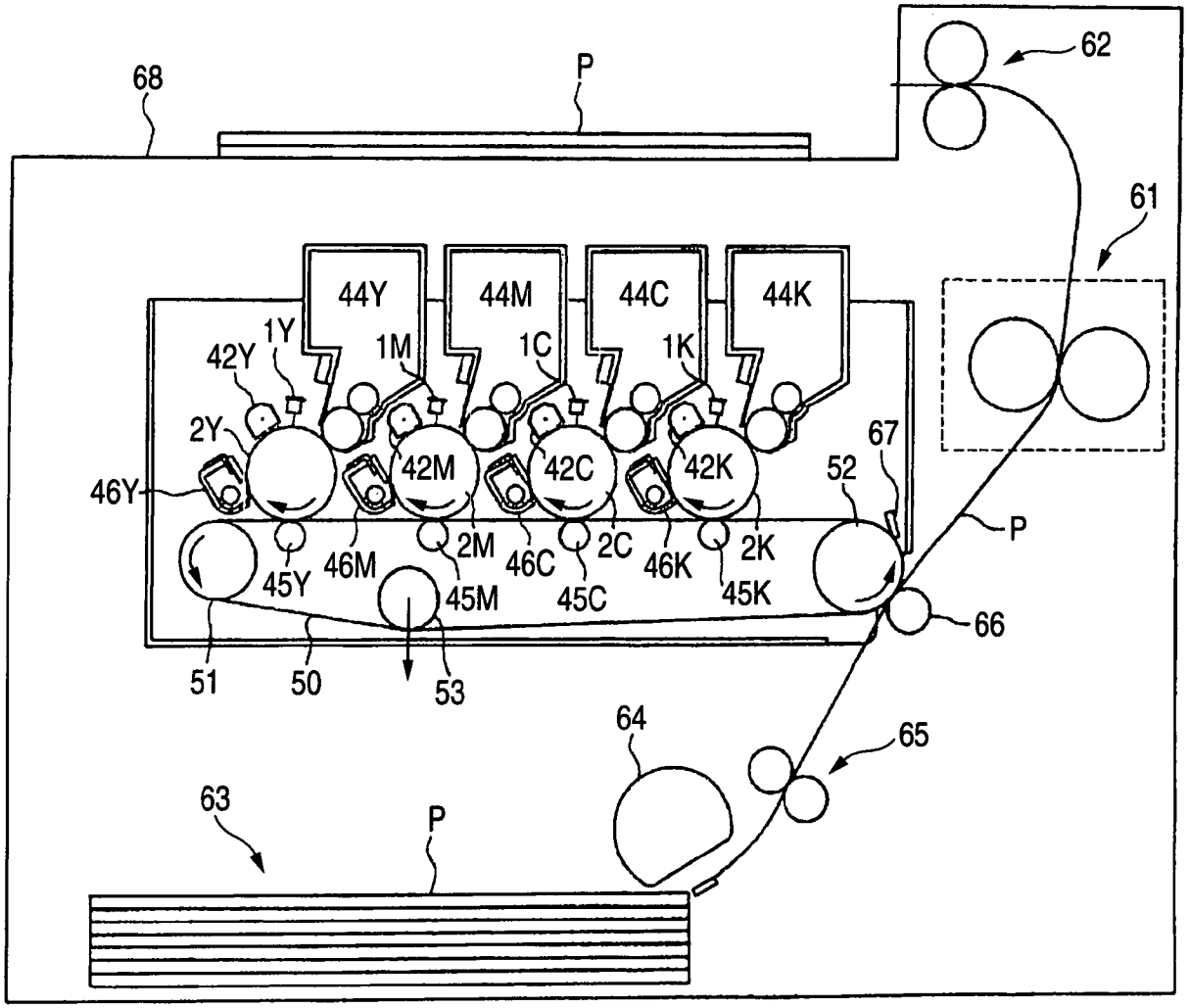
FIG. 8 is a schematic section view of the image forming apparatus.

The above-described exposer 1 may be used for a color image forming apparatus using an electrophotographic method, for example. FIG. 8 shows an example of a color image forming apparatus using a tandem method in which four line heads 1K, 1C, 1M and 1Y are provided in the exposing positions of four corresponding same photosensitive drums (photosensitive members) 2K, 2C, 2M and 2Y respectively.

The image forming apparatus comprises an intermediate transferring belt 50 to which a tension is applied by a driving roller 51, a follower roller 52 and a tension roller 53 and which is thus stretched and is circulated in the direction of an arrow in the drawing (a counterclockwise direction), and the photosensitive members 2K, 2C, 2M and 2Y having photosensitive layers on outer peripheral surfaces are arranged at a regular interval with respect to the intermediate transferring belt 50.

While the photosensitive members 2K, 2C, 2M and 2Y are rotated in the direction of an arrow in the drawing (a clockwise direction) synchronously with the driving operation of the intermediate transferring belt 50, corona chargers 42 (K, C, M, Y) uniformly charge the outer peripheral surfaces of the photosensitive members 2 (K, C, M, Y), and the line heads 1 (K, C, M, Y) sequentially carry out exposure over the outer peripheral surfaces charged uniformly by the chargers 42 (K, C, M, Y) synchronously with the rotation of the photosensitive members 2 (K, C, M, Y). Developing devices 44 (K, C, M, Y) give toner serving as a developer to electrostatic latent images formed by the line heads 1 (K, C, M, Y) to form visible images (toner images), and primary transferring rollers 45 (K, C, M, Y) sequentially transfer the toner images developed by the developing devices 44 (K, C, M, Y) to the intermediate transferring belt 50 by applying a primary transferring bias. Cleaners 46 (K, C, M, Y) remove toner remaining on the surfaces of the photosensitive members 2 (K, C, M, Y) after the primary transfer are provided around the photosensitive members 2 (K, C, M, Y), respectively.

The developing devices 44 (K, C, M, Y) use a non-magnetic one-component toner, for example, and serve to deliver the one-component developer to a developing roller by a feeding roller, for example, and to regulate the thickness of the film of the developer stuck to the surface of the developing roller by a regulating blade, to cause the developing roller to come in contact with the photosensitive members 2 (K, C, M, Y) or to press the developing rollers against the photosensitive members 2 (K, C, M, Y) to stick the developer corresponding to the potential levels of the photosensitive members 2 (K, C, M, Y), thereby carrying out a development to form toner images.

Toner images having black, cyan, magenta and yellow colors are superposed sequentially on the intermediate transferring belt 50 so that a toner image having a full color is formed. The full color toner image is secondarily transferred to a recording medium P such as paper through a secondary transferring roller 66, passes through a fusing roller pair 61 and is thus fused onto the recording medium P. The recording medium P is ejected onto an ejection tray 68 formed in the upper part of the apparatus by an ejecting roller pair 62.

In FIG. 8, numeral 63 denotes a sheet feeding cassette for laminating and holding a large number of recording media P; numeral 64 denotes a pickup roller for feeding the recording media P one by one from the paper feeding cassette 63; numeral 65 denotes a gate roller pair for regulating the feeding timing of the recording media P to a secondary transferring position at which of a secondary transferring roller 66 is brought into contact with the intermediate transferring belt 50; and numeral 67 denotes a cleaning blade for removing toner remaining on the surface of the intermediate transferring belt 50 after the secondary transfer is performed.

Figure 9:
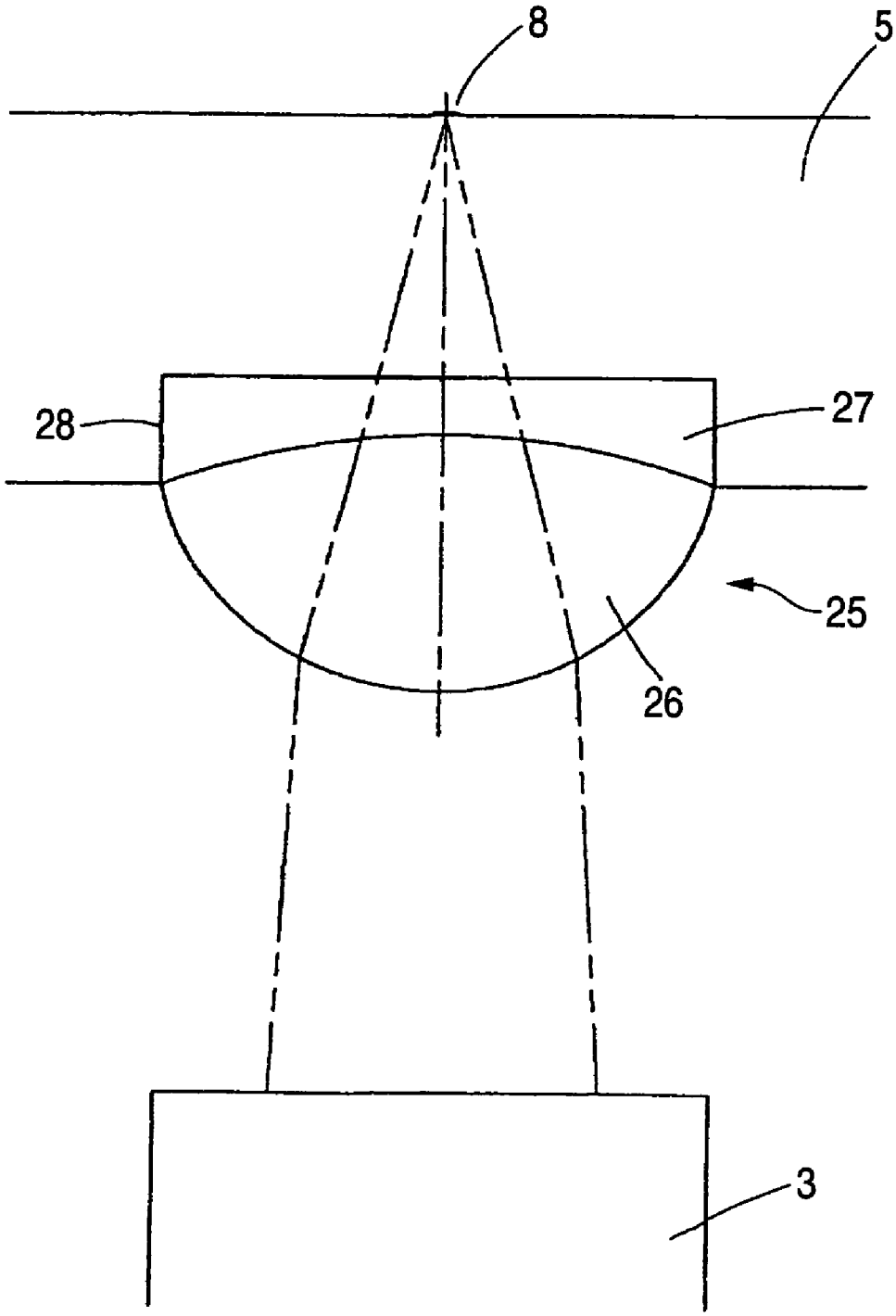
FIG. 9 of an enlarged section view of a line head according to a second embodiment of the invention.

Next, a second embodiment of the invention will be described with reference to FIG. 9. Components similar to those in the first embodiment will be designated by the same reference numerals and repetitive explanations for those will be omitted here.

In this embodiment, the chromatic-aberration correcting lens 25 is formed integrally with a surface on the opposite side of a surface of the transparent substrate 5 on which the organic-EL photo emitters 6 are formed. The chromatic-aberration correcting lens 25 is formed by injecting a material to be the first lens 27 into a hole 26 formed on the transparent substrate 5 through the use of an ink jet technique, and landing a material to be the second lens 26 thereon by the same technique.

Since the chromatic-aberration correcting lens 25 is formed integrally with the transparent substrate 5, it is possible to reduce the size of the apparatus, and furthermore, to cause the central position of the light emitting section 8 to be coincident with the central position of the chromatic-aberration correcting lens 25 during a manufacturing process.

The ink jet technique includes a technique utilizing the mechanical energy of a piezoelectric element for ejecting the material to be the lens, and a technique the thermal energy of a heater for ejecting the material to be the lens.

Next, a third embodiment of the invention will be described with reference to FIGS. 10 to 12. Components similar to those in the first embodiment will be designated by the same reference numerals and repetitive explanations for those will be omitted here.

Figure 10:
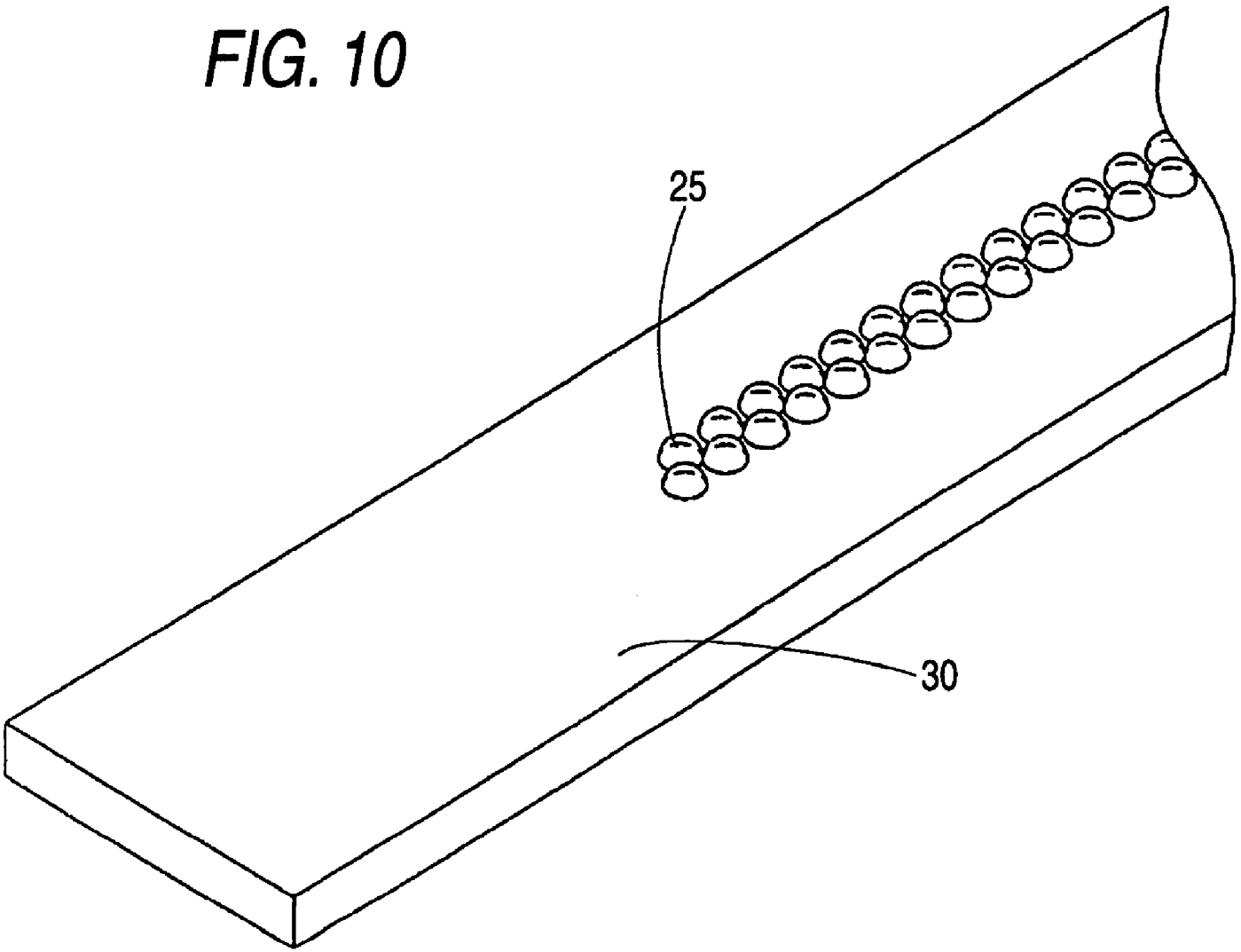
FIG. 10 is a perspective view of chromatic-aberration correcting lenses in a line head according to a third embodiment of the invention.
Figure 11:
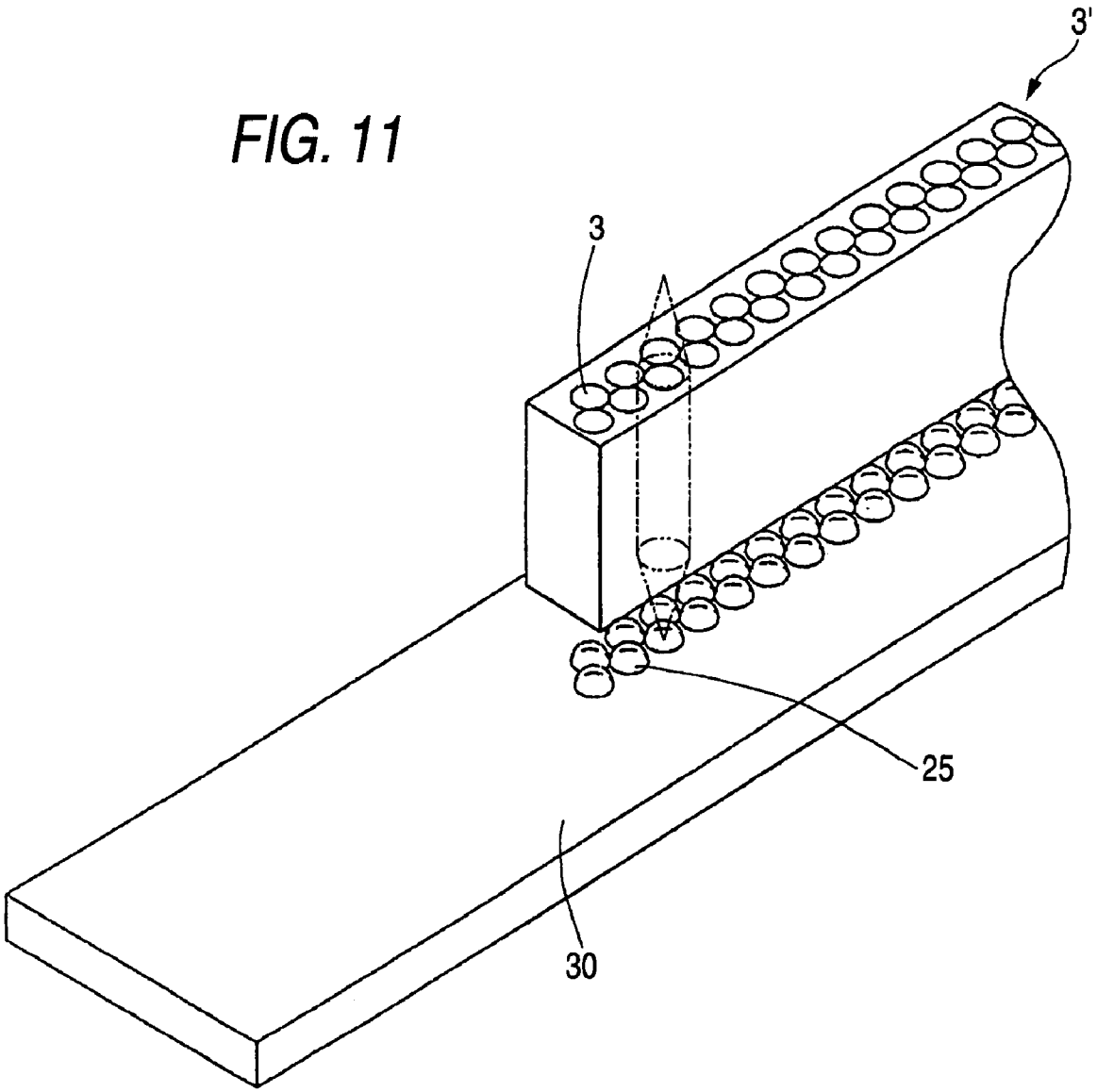
FIG. 11 is a perspective view showing a relationship between rod lenses and the chromatic-aberration correcting lenses.

In this embodiment, a plurality of chromatic-aberration correcting lenses 25 are arrayed in a longitudinal direction of an elongated substrate 30 as shown in FIG. 10. The chromatic-aberration correcting lenses 25 are arranged on the substrate 30 so as to correspond to the rod lenses 3 in a one-by-one manner as shown in FIG. 11. With this configuration, the aberration correcting effect can be further enhanced.

Figure 12:
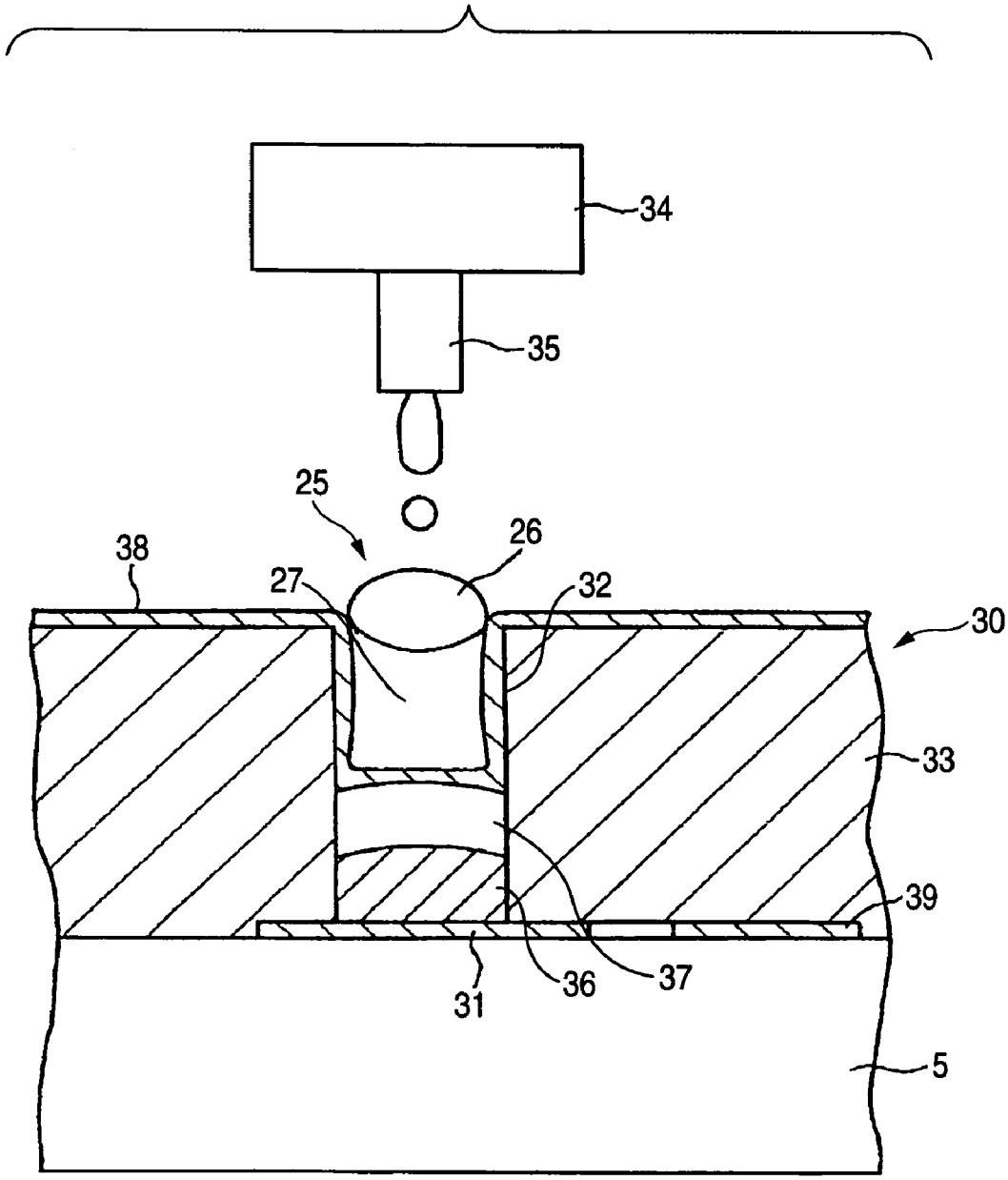
FIG. 12 is a section view for explaining how to fabricate the line head of the third embodiment.
Figure 13:
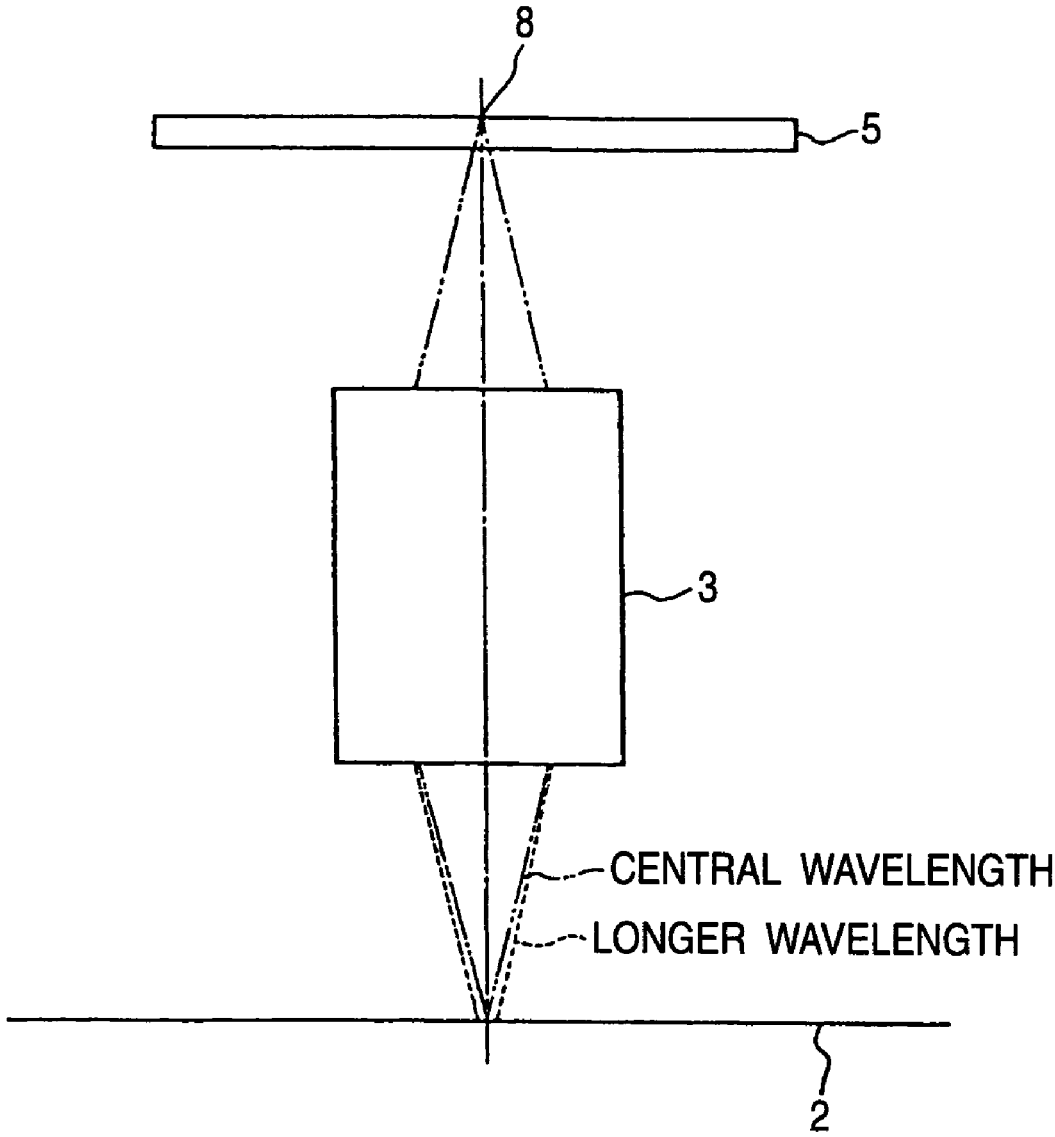
FIGS. 13 and 14 are diagrams for explaining enlargement of a beam spot size on a photosensitive member in a case where a gradient index lens is used.
Figure 14:
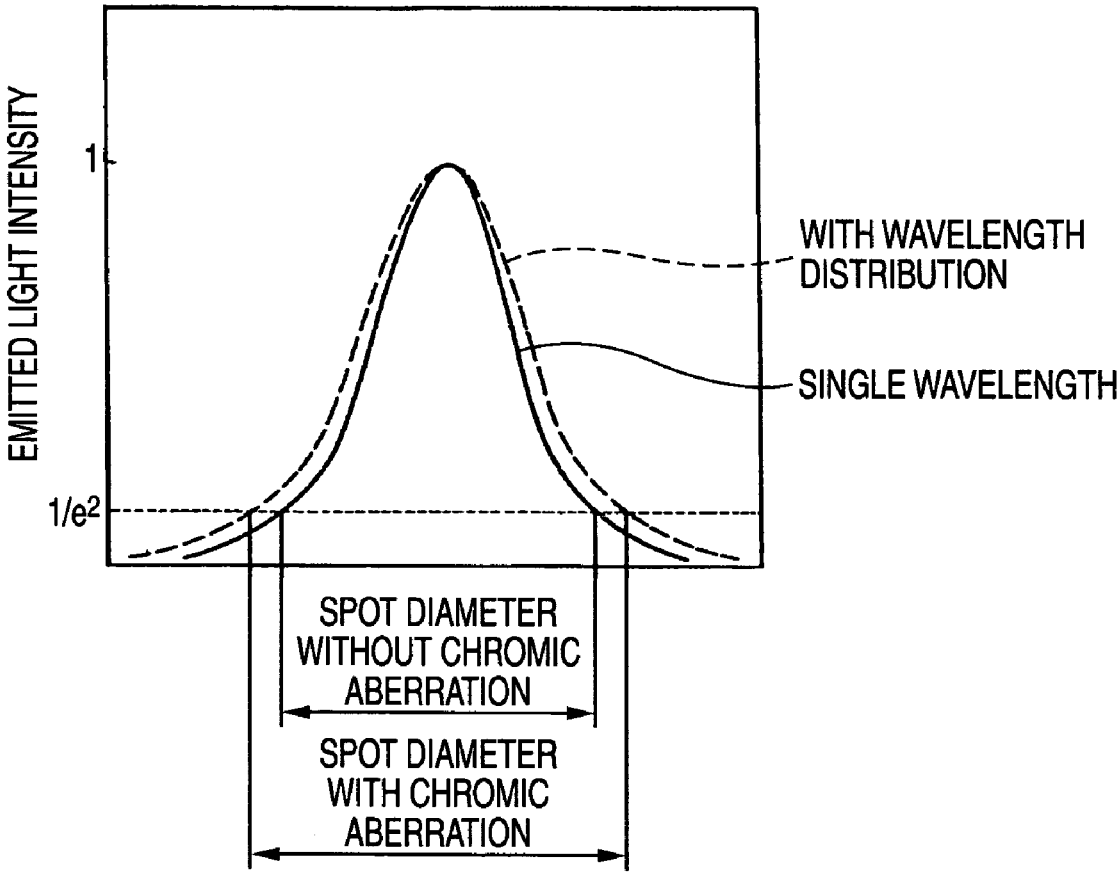

FIG. 12 shows one example to fabricate chromatic-aberration correcting lens 25 of this embodiment. First, a TFT 39 is fabricated on the transparent substrate 5. There has variously been known a method of fabricating the TFT 39. For example, a silicon oxide film is first deposited on the transparent substrate 5, and furthermore, an amorphous silicon film is deposited thereon. Next, an excimer laser beam is irradiated on the amorphous silicon film to carry out a crystallization, thereby forming a polisilicon film to be a channel. The polysilicon film is subjected to patterning and a gate insulating film is then deposited, and furthermore, a gate electrode formed of tantalum nitride is provided. Subsequently, source and drain portions in an N-channel TFT are formed by the ion implantation of phosphorus and source and drain portions in a P-channel TFT are formed by the ion implantation of boron. The impurities implanted as ion are activated, and thereafter, a first interlayer insulating film is deposited, a first contact hole is opened, a source line is formed, a second interlayer insulating film is deposited, a second contact hole is opened, and a metal pixel electrode is formed in this order so that the array of the TFT 39 is finished. The metal pixel electrode is formed by a cathode 31 of the light emitting section 8 in the organic-EL photo emitter 6 and also serves as the reflecting layer of the light emitting section 8 in the organic-EL photo emitter, and is formed by a metallic thin film electrode such as Mg, Ag, Al or Li.

Subsequently, a bank 33 provided with a hole 32 corresponding to the light emitting section 8 of the organic-EL photo emitter 6 and having a predetermined height is formed. The bank 33 can be formed by various methods such as a photolithographic method or a printing method. For example, in a case where the photolithographic method is used, an organic material is applied corresponding to the height of the bank by a predetermined method such as spin coating, spray coating, roll coating, dye coating or dip coating, and a resist layer is applied thereto. Then, a mask is applied corresponding to the shape of the bank 33 and the resist is exposed and developed so that the resist conforming to the shape of the bank 33 is left.

Finally, the material of the bank 33 is subjected to etching. Thus, the material of the bank 33 in a portion other than the mask is removed. Moreover, a bank (convex portion) may be formed by at least two layers having lower and upper layers constituted by an inorganic matter and an organic matter respectively. Furthermore, a material for constituting the bank 33 which has a durability to the solvent of an EL material is not particularly restricted. For example, an organic material such as an acrylic resin, an epoxy resin or photosensitive polyimide is preferable because they can be changed into Teflon (registered trademark) by a phlorocarbon gas plasma treatment. It is also possible to use a laminated bank having an inorganic material such as liquid glass to be a lower layer. Moreover, it is desirable that the bank 33 should be black or opaque by mixing carbon black into the material.

Next, the substrate provided with the bank 33 is subjected to a continuous plasma treatment using an oxygen gas and a phlorocarbon gas plasma immediately before an ink composite for an organic-EL light emitting layer is applied. Consequently, the surface of polyimide constituting the bank 33 is caused to be water-repellent and the surface of the cathode 31 is caused to be hydrophilic, for example, and it is possible to control a wettability on a substrate side for finely patterning an ink jet droplet. For an apparatus for generating a plasma, it is also possible to use an apparatus for generating a plasma in a vacuum and an apparatus for generating a plasma in the air.

Then, an ink composite for the light emitting layer is ejected from a head 35 of a liquid ejecting device 34 using the ink jet technique into the hole 32 of the bank 33, and the cathode 31 of each pixel is subjected to a patterning application. After the application, the solvent is removed and a heat treatment is carried out to form a light emitting layer 36.

After the light emitting layer 36 is formed in the hole 32, an ink composite for a hole-injected layer is ejected from the head 35 of the liquid ejecting device 34 onto the light emitting layer 36 in the hole 32, thereby carrying out a patterning application over the light emitting layer 36 of each pixel. After the application, the solvent is removed, and a heat treatment is carried out to form the hole-injected layer 37.

The order of the light emitting layer 36 and the hole-injected layer 37 may be reversed. It is desirable that a layer having a resistance to water should be provided on a surface side (a side placed apart from the transparent substrate 5 more greatly).

Moreover, the light emitting layer 36 and the hole-injected layer 37 can also be fabricated by a spin coating method, a dipping method or an evaporation method which is well known in place of the application of the ink composite by the ink jet technique as described above.

For a material to be used for the light emitting layer 36 and a material to be used for the hole-injected layer 37, furthermore, it is possible to utilize various well-known materials disclosed in Japanese Patent Publication Nos. 10-12377A and 2000-323276A, for example, and detailed description will be omitted.

After the light emitting layer 36 and the hole-injected layer 37 are formed in order in the hole 32 of the bank 33, the whole surface of the substrate is covered with a transparent electrode 38 to be an anode for an organic-EL photo emitter 6 by a vacuum evaporation method. The material of the transparent electrode 38 includes a tin oxide film, an ITO film, and a complex oxide film of indium oxide and zinc oxide, and a photolithographic method, a sputtering method and a pyrosol method can be employed in place of a vacuum evaporation method. By such methods, the transparent electrode 38 is formed on the upper surface of the bank 33 and the whole internal surface of the hole 32.

Subsequently, the surface of the transparent electrode 38 is subjected to a water repellent treatment and a transparent ink composite for a microlens is ejected from the head 35 of the liquid ejecting device 34 into the hole 32 of the bank 33 to carry out a patterning application, and curing is performed after the application to form a concave microlens to be the first lens 27 of the chromatic-aberration correcting lens 25 on each light emitting section 8. A convex microlens to be the second lens 26 of the chromatic-aberration correcting lens 25 is formed on the first lens 27 to be the concave microlens by ejecting the transparent ink composite from the head 35 of the liquid ejecting device 34, carrying out a patterning application and performing curing after the application.

The radii of curvature of the surfaces of the first and second lenses 26 and 27 constituting the chromatic-aberration correcting lens 25 are determined by the amount of discharge of the ink composite, the diameter of the hole 32, the surface tension of the transparent ink composite for the microlens, the degree of a water repellency to the transparent electrode 38, and the amount of contraction in the curing of the ink composite.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A color image forming apparatus, comprising:

a plurality of photosensitive members;

a plurality of line heads, each of which corresponds to each of the photosensitive members and comprises:

a substrate having a first face and a second face opposite to the first face;

a plurality of photo emitter arrays arranged on the first face in a secondary scanning direction, each of which includes a plurality of organic-EL photo emitters arranged on the first face in a primary scanning direction perpendicular to the secondary scanning direction, each of the photo emitter arrays operable to emit light having a same single peak wavelength distribution;

a plurality of imaging lenses, arrayed in the primary scanning direction to form at least one lens array, so that an array of pixels defined on the corresponding photosensitive member are subjected to multiple exposure to the light emitted from the photo emitter arrays in accordance with the movement of the corresponding photosensitive member, thereby forming an electrostatic latent image on the corresponding photosensitive members;

a single chromatic-aberration correcting lens, adapted to correct chromatic aberration of the imaging lenses relative to the secondary scanning direction so as to prevent a spot diameter on the corresponding photosensitive member from being increased due to the single peak wavelength distribution of the light emitted from the photo emitter arrays, and disposed on the second face and between the photo emitter arrays and the lens array;

a plurality of developing sections, each of which corresponds to each of the photosensitive members and is adapted to give toner to the electrostatic latent image, thereby forming a toner image on the corresponding photosensitive member; and a transferring section, adapted to transfer toner images on the photosensitive members, each of which has different color to a recording medium, thereby forming a color image on the recording medium, wherein the single chromatic-aberration correcting lens is elongated in the primary scanning direction so as to face all of the organic-EL photo emitters;

the single chromatic-aberration correcting lens is comprised of a concave first portion elongated in the primary scanning direction and a convex second portion elongated in the primary scanning direction and integrated with the concave first portion; and the substrate and the single chromatic-aberration correcting lens are materially different from each other.

2. The image forming apparatus as set forth in claim 1, wherein the chromatic-aberration correcting lens is separately provided from a substrate on which the photo emitter arrays are provided.

3. The image forming apparatus as set forth in claim 1, wherein the chromatic-aberration correcting lens is integrally formed with a substrate on which the photo emitter arrays are provided.

4. The color image forming apparatus as set forth in claim 1, wherein each of the organic-EL photo emitters includes:

a substrate;

a bank, formed on the substrate and provided with a hole;

a light emitting section, formed in the hole, wherein at least a part of the chromatic-aberration correcting member is disposed in the hole.

5. An image forming apparatus, comprising:

a plurality of photosensitive members;

a plurality of line heads, each of which corresponds to each of the photosensitive members and comprises:

a substrate having a first face and a second face opposite to the first face;

a plurality of photo emitter arrays arranged on the first face in a secondary scanning direction, each of which includes a plurality of organic-EL photo emitters arranged on the first face in a primary scanning direction perpendicular to the secondary scanning direction, each of the photo emitter arrays operable to emit light having a same single peak wavelength distribution;

a plurality of imaging lenses, arrayed in the primary scanning direction to form at least one lens array, and adapted to receive the light emitted from the photo emitter arrays, thereby forming an electrostatic latent image on the corresponding photosensitive member;

a single chromatic-aberration correcting member, disposed on the second face and between the photo emitter arrays and the lens array, and adapted to correct chromatic aberration of the imaging lenses relative to the secondary scanning direction so as to prevent a spot diameter on the corresponding photosensitive member from being increased due to the single peak wavelength distribution of the light emitted from the photo emitter arrays;

a plurality of developing sections, each of which corresponds to each of the photosensitive members and is adapted to give toner to the electrostatic latent image, thereby forming a toner image on the corresponding photosensitive member; and a transferring section, adapted to transfer toner images on the photosensitive members, each of which has different color to a recording medium, thereby forming a color image on the recording medium, wherein the single chromatic-aberration correcting lens is elongated in the primary scanning direction so as to face all of the organic-EL photo emitters;

the single chromatic-aberration correcting lens is comprised of a concave first portion elongated in the primary scanning direction and a convex second portion elongated in the primary scanning direction and integrated with the concave first portion; and the substrate and the single chromatic-aberration correcting lens are materially different from each other.

6. The image forming apparatus as set forth in claim 5, wherein each of the organic-EL photo emitters includes:

a substrate;

a bank, formed on the substrate and provided with a hole;

a light emitting section, formed in the hole, wherein at least a part of the chromatic-aberration correcting member is disposed in the hole.

7. A line head, comprising:

a substrate having a first face and a second face opposite to the first face;

a plurality of photo emitter arrays arranged on the first face in a secondary scanning direction, each of which includes a plurality of organic-EL photo emitters arranged on the first face in a primary scanning direction perpendicular to the secondary scanning direction, each of the photo emitter arrays operable to emit light having a same single peak wavelength distribution;

a plurality of imaging lenses, arrayed in the primary scanning direction to form at least one lens array, and adapted to receive the light emitted from the photo emitter arrays, thereby forming an electrostatic latent image on a photosensitive member; and a single chromatic-aberration correcting member, disposed on the second face and between the photo emitter arrays and the lens array, and adapted to correct chromatic aberration of the imaging lenses relative to the secondary scanning direction so as to prevent a spot diameter on the photosensitive member from being increased due to the single peak wavelength distribution of the light emitted from the photo emitter arrays, wherein the single chromatic-aberration correcting lens is elongated in the primary scanning direction so as to face all of the organic-EL photo emitters;

the single chromatic-aberration correcting lens is comprised of a concave first portion elongated in the primary scanning direction and a convex second portion elongated in the primary scanning direction and integrated with the concave first portion; and the substrate and the single chromatic-aberration correcting lens are materially different from each other.

8. The line head as set forth in claim 7, wherein each of the organic-EL photo emitters includes:

a substrate;

a bank, formed on the substrate and provided with a hole;

a light emitting section, formed in the hole, wherein at least a part of the chromatic-aberration correcting member is disposed in the hole.

* * * * *